US005158189A

United States Patent [19]

Watson et al.

[11] Patent Number: 5,158,189

[45] Date of Patent: Oct. 27, 1992

[54] BOOM SUPPORT SYSTEM

[75] Inventors: Ronald L. Watson, Henderson; Jerry L. Fugate, Madisonville, both of Ky.

[73] Assignee: Watson Brothers Industries, Inc., Madisonville, Ky.

[21] Appl. No.: 805,942

[22] Filed: Dec. 12, 1991

[51] Int. Cl.[5] ..... B66C 23/00

[52] U.S. Cl. ..... 212/269

[58] Field of Search ..... 212/266, 269, 223, 232, 212/238, 253, 255, 260, 261, 230, 264; 52/118; 384/261, 276, 912, 913

[56] References Cited

U.S. PATENT DOCUMENTS

| | | | |
|---|---|---|---|
| 3,719,404 | 3/1973 | Sterner | 212/269 |
| 3,782,790 | 1/1974 | Benkowski | 212/269 |
| 4,759,452 | 7/1988 | Faint et al. | 212/269 |
| 4,781,882 | 11/1988 | Salton et al. | 212/269 |

*Primary Examiner*—Joseph F. Peters, Jr.
*Assistant Examiner*—Stephen P. Avila
*Attorney, Agent, or Firm*—Fleit, Jacobson, Cohn, Price, Holman & Stern

[57] ABSTRACT

A boom support system such as those used on various hoisting equipment, such as cranes or the like, mine scaling equipment and other equipment utilizing telescopic booms. The boom support system includes a plurality of longitudinally extending support rails spaced circumferentially of the telescopic boom components with radially adjustable slides on the telescopic boom components engaged with the rails for guiding and supporting the telescopic components during their telescopic movement.

7 Claims, 2 Drawing Sheets

BOOM SUPPORT SYSTEM

BACKGROUND OF THE INVENTION

1. Field of the Invention

The present invention generally relates to a boom support system and more specifically to telescopic booms such as those used on various hoisting equipment, such as cranes or the like, mine scaling equipment and other equipment utilizing telescopic booms. The boom support system includes a plurality of longitudinally extending support rails spaced circumferentially of the telescopic boom components with radially adjustable slides on the telescopic components engaged with the rails for guiding and supporting the telescopic components during their telescopic movement.

2. Description of the Prior Art

Telescopic booms are conventionally employed on various types of equipment with the telescopic components of the boom being extended and retracted by forces applied by hydraulic cylinder assemblies or cable mechanisms. The telescopic components of the booms in their collapsed or completely telescoped position are substantially nested with the telescopic components being extended longitudinally outwardly in multiple stages to provide a desired boom length generally referred to as a range of reach. The extendable and retractable telescopic boom components are supported in various manners with one arrangement including the use of the hydraulic cylinder as the load bearing boom in which the telescopic stages are supported by internal bushings. Usually, the boom components are formed by a structural framework which is usually square or rectangular in design which requires the steel structures to slide against each other with flat steel or brass supports being provided to reduce friction between the telescopic components and in other arrangements, rollers have been used to further reduce friction in situations where rollers can support the loads to be handled by the boom. The following U.S. patents disclose various developments in the field of telescopic booms.

3,648,850
3,674,157
3,830,376
3,931,698
4,004,695

While the above patents disclose various types of telescopic booms, they do not disclose the specific structure of the guide and supporting rails and slide arrangement including the specific bracket and adjustment structure incorporated into this invention which provides a reliable, long life in which the boom components cannot rotate about a longitudinal axis with the structure especially adapted for use in mine scaling operations since the structural arrangements of the present invention do not require lubrication even though used in a relatively high abrasion environment.

SUMMARY OF THE INVENTION

An object of the present invention is to provide a boom support system including telescopic boom components of rectangular or square configuration with each of the boom components including longitudinally extending hardened and chromed guiding and supporting rails at circumferentially spaced locations on each of the boom components combined with correspondingly positioned support slides on each of the components in sliding engagement with the rails with each of the slides including an arcuate slide surface engaged with a substantial portion of the periphery of the rails which are of cylindrical configuration.

Another object of the invention is to provide a boom support system in accordance with the preceding object in which the rails are induction hardened and chromed and each of the slide assemblies includes radially adjustable steel shoes with fiber or plastic based slide bushings, such as nylon or the like together with bracket structure which provides simplified access for maintenance and replacement of the slide assemblies with the construction and location of the components resisting twisting or rotation of the boom components about a longitudinal axis and eliminating necessity the of providing lubrication capabilities thereby providing a boom assembly which is simpler and easier to maintain and providing a boom assembly that has extended structural and support life expectancy.

A further object of the present invention is to provide a boom support system especially advantageous in mine scaling operations where resistance to relative rotation about a longitudinal axis is required in side wall scaling and no lubrication is required even though the boom is used in an area in which the environment normally contains substantial abrasive material with the present invention providing large contact bearing surfaces to provide maximum support but without the high friction characteristic of a flat slide system and also providing low friction characteristics similar to a roller support arrangement but without the high point pressure contact characteristic or a roller periphery engaging a flat bearing surface and which also eliminates the need to lubricate the slide surfaces and/or roller pins and bushings as required in other telescopic boom support systems.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
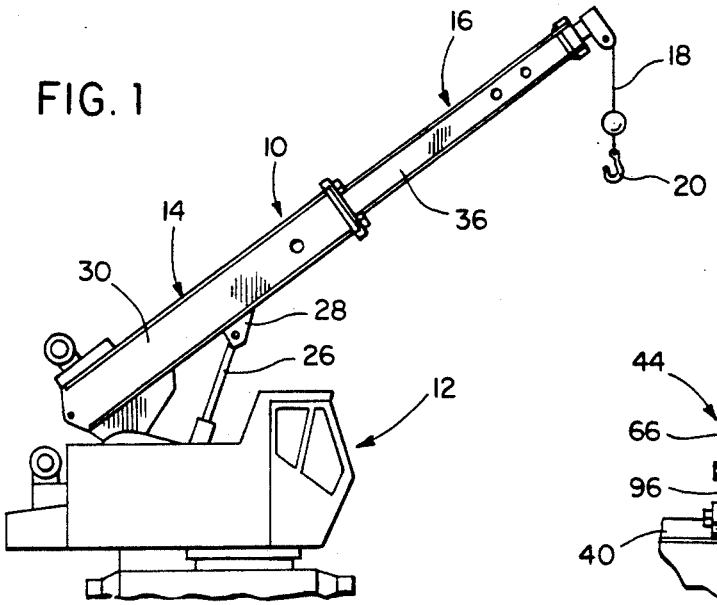
FIG. 1 is a side elevational view illustrating the boom support system of the present invention incorporated into a hoisting crane.
Figure 8:
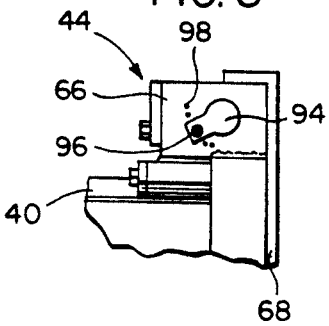
FIG. 8 is a detailed view illustrating the radial adjustment capabilities of a slide assembly.

Referring now specifically to the drawings, the boom support assembly of the present invention is generally designated by reference numeral 10 and, in FIG. 1, is illustrated in association with a crane generally designated by reference numeral 12 which is of conventional construction and provided with the necessary prime mover, hydraulic system, controls and the like which supports the boom for pivotal movement about a horizontal axis, swinging movement about a vertical axis and provided with equipment to extend and retract the boom 10.

The boom 10 includes multiple stages including telescopic boom components 14 and 16 with the boom component 14 telescopically receiving the boom component 16 internally thereof for longitudinal extension and retraction by the use of conventional equipment. It is pointed out that multiple stages of boom components may be employed with the outermost boom component 16 including a lifting cable 18 with load supporting hook 20 thereon which is of conventional construction. Likewise, the boom component 14 includes support gussets 22 at the inner end thereof for pivotal supporting engagement from the crane 12 by a pin structure which extends through bearings 24. A hydraulic piston and cylinder assembly 26 interconnects the crane 12 and bracket structures 28 on the boom component 14. The structure to adjustably support the boom 10 from the crane is conventional as is the power structure for raising and lowering the load, extending and retracting the boom and positioning the boom in desired angular position with the present invention being directed specifically to the structural details of the boom 10 including the telescopic components 14 and 16.

Figure 4:
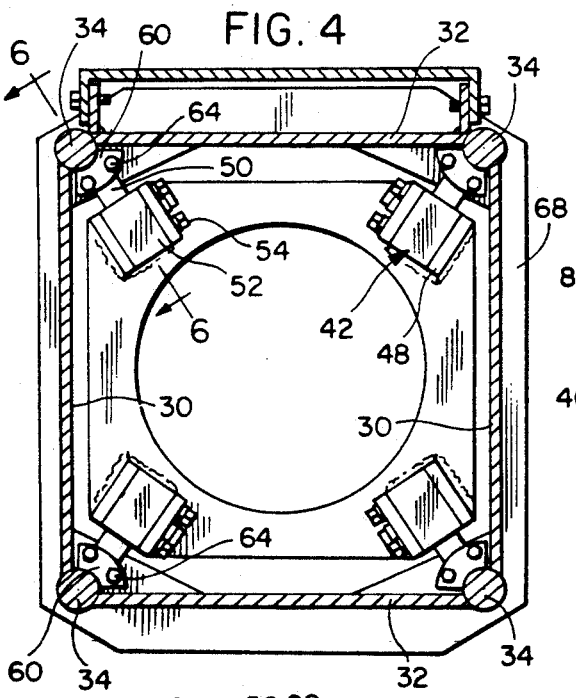
FIG. 4 is a transverse, sectional view, on an enlarged scale, taken along section line 4—4 on FIG. 2 illustrating further structural details of the invention.

As illustrated in FIGS. 2–5, the boom component 14 is of generally square or rectangular configuration and includes a pair of opposed, vertically disposed, parallel side plates or frames 30 and a pair of opposed, top and bottom plates or frames 32 which are joined at their edges by four longitudinally continuous rails 34 of cylindrical cross-sectional configuration which are induction hardened and chromed to provide an external cylindrical surface to which the plates or frames 30 and 32 are rigidly connected as best illustrated in FIG. 4.

The boom component 16 also includes a pair of parallel side plates or frames 36 which are vertically disposed and a pair of horizontal, opposed top and bottom plates or frames 38 which are connected by longitudinally continuous rails 40 at each corner of the boom. As illustrated, the transverse configuration of both of the booms are square or rectangular with the dimensions of the boom 16 being such that the boom 16 can telescope interiorly of the boom component 14.

Figure 6:
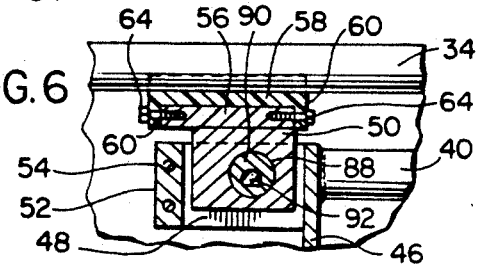
FIG. 6 is a sectional view taken along section line 6—6 on FIG. 4 illustrating further structural details of the internal slide assembly.
Figure 3:
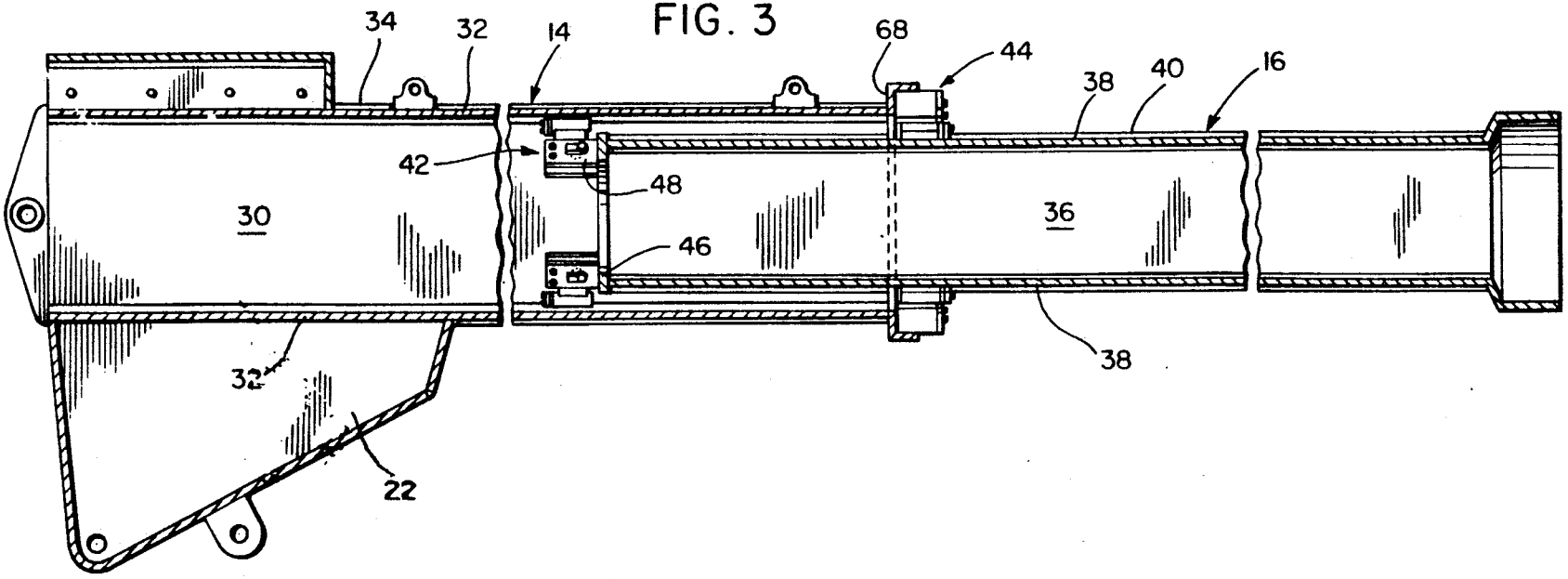
FIG. 3 is a longitudinal, sectional view, on an enlarged scale, taken substantially along section line 3—3 on FIG. 2 illustrating the structural relationship between telescopic boom components.

As illustrated in FIGS. 3, 4 and 6, the inner end of the boom component 16 is provided with slide assemblies generally designated by reference numeral 42 which face outwardly and are in slidable engagement with the inner arcuate surface of the rail 34 with a slide assembly being provided at each corner of the boom component 16 thus stabilizing and supporting the inner end of the boom component 16 from the rails 34 on the boom component 14 to provide longitudinal sliding support and prevents relative rotational movement between the boom components 14 and 16.

Figure 5:
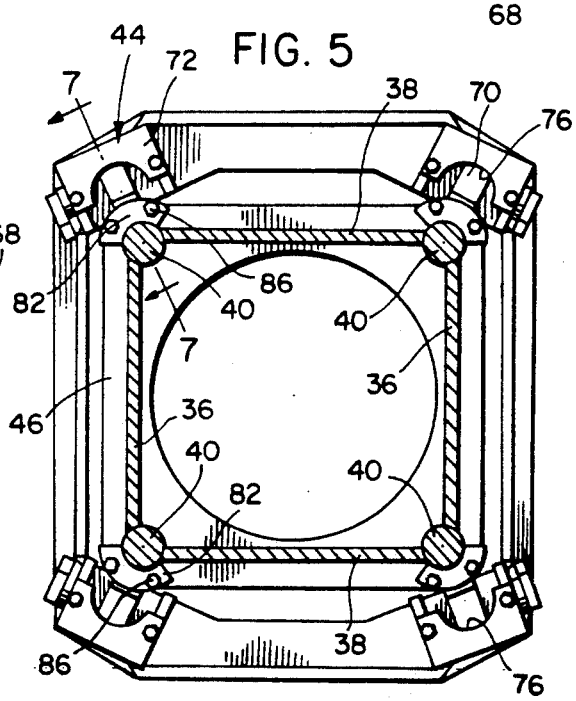
FIG. 5 is a transverse, sectional view, on an enlarged scale, taken along section 5—5 on FIG. 2 illustrating further structural details of the invention.
Figure 7:
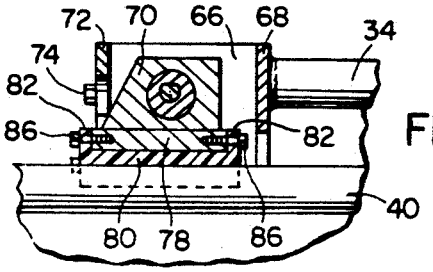
FIG. 7 is a sectional view taken along section line 7—7 on FIG. 5 illustrating structural details of the external slide assembly.
Figure 2:
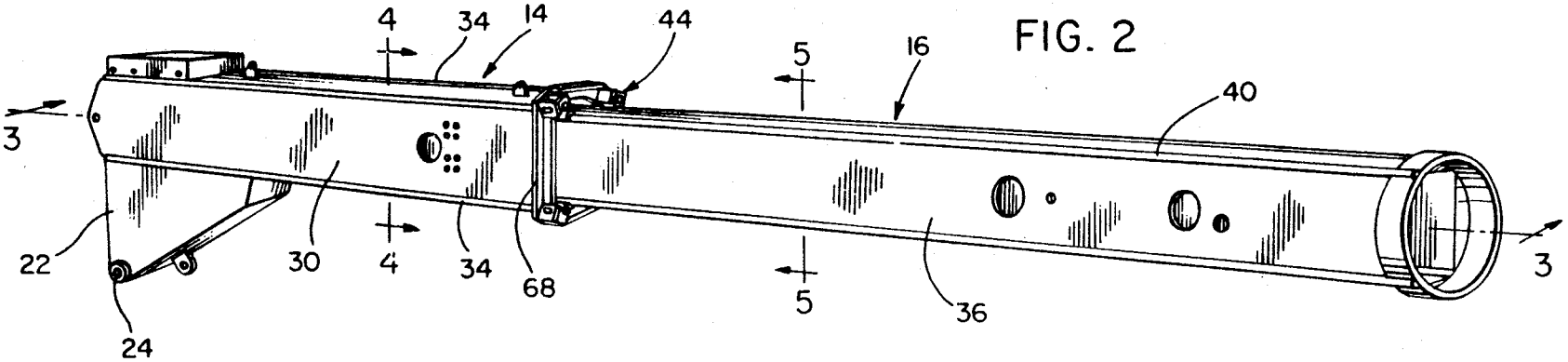
FIG. 2 is a perspective view of the telescopic boom support system of the present invention.

As illustrated in FIGS. 3, 5 and 7, the outer end of the boom component 14 is provided with slide assemblies generally designated by reference numeral 44 which are in sliding engagement with the outer surface of the rails 40 thereby providing a sliding support for the portion of the boom component 16 which slides into the boom component 14 and prevents relative axial rotation of the boom components 14 and 16 about a longitudinal axis in relation to each other thereby providing a supporting and guiding system for the telescopic boom components 14 and 16 as they are extended and retracted in relation to each other.

As illustrated in FIGS. 3, 4 and 5, the slide assemblies 42 are mounted on a peripheral frame plate 46 that is rigid with the inner end of the boom component 16 with each slide assembly including a pair of bracket plates 48 welded to or otherwise rigidly affixed to the plate 46 with the bracket plates 48 being in spaced parallel relation to receive a mounting plate 50 therebetween. The ends of the bracket plates 48 are interconnected by an end plate 52 which forms a rock guard and is secured in place by fastening bolts 54. The mounting plate 50 terminates in an arcuate saddle 56 that is rigid therewith which forms a slide shoe and a busing or bearing insert 58 is received in the saddle and is also of arcuate configuration to engage the internal arcuate surface of the guide rail 34 on the boom component 14. The bushing 58 includes end flanges 60 which engage the ends of saddle 56 and are releaseably secured at both ends by bolts 64 which thread into the ends of saddle 56 to retain the bushing 58 in place thus enabling easy and quick access and replacement of the bushing 58 when this becomes necessary during normal use.

As illustrated in FIGS. 3, 5 and 7, each of the slide assemblies 44 includes a pair of parallel bracket plates 66 welded to a peripheral end plate 68 mounted on the end of the plates 30 and 32 and rails 34 on the boom component 14. The bracket plates 66 receive and support a mounting plate 70 therebetween with the ends of bracket plates being interconnected by an end plate 72 forming a rock guard and is secured in place by fastener bolts 74 with the inner edge of the end plate 72 including ar arcuate recess 76 which provides for reception of an inclined outer edge of the mounting plate 70 as illustrated in FIGS. 5 and 7. The inner edge of the mounting plate 70 includes a saddle 78 of arcuate configuration receiving a bushing or bearing insert 80 of arcuate configuration therein which engages the outer peripheral surface of the rails 40 on the boom component 16 as illustrated in FIGS. 3, 5 and 7. The bushing 80 includes a flange 82 on each end which engages the end edges of saddle 78 and are secured thereto by bolts 86 to provide easy and quick access to the bushing 80 in order to replace the bushing when necessary.

With the arrangement of the slide assemblies 42 and 44, the boom components 14 and 16 are structurally supported and guided in an effective manner with the orientation and construction of the boom components, the guide rials 34 and 40 and the slide assemblies 42 and 44 enabling extension and retraction of the boom components and preventing relative rotation about a longitudinal axis thereby maintaining the outer boom component 16 in a fixed position with respect to its longitudinal axis to enable effective use of the boom such as is required in sidewall scaling in a mine scaling procedure. The cylindrical cross-sectional configuration of the rails and the bushings and saddle provide large contact surfaces but do not introduce high friction characteristics which are encountered in a flat slide system. The construction and configuration of the rails and slide assemblies obtains a desired low friction similar to that obtained by a roller support arrangement but the construction of this invention eliminates line contact between the periphery of a roller and a supporting surface which produces a high pint pressure contact in a roller system. In addition to obtaining low friction without high point pressure contact and obtaining large surface contact without high friction as in a flat slide system, the present invention also is capable of withstanding large axial or twisting loads by providing adequate support which are not capable in flat slide assemblies or roller flange assemblies.

The slide assemblies 42 and 44 are also capable of radial adjustment in which the mounting plates 50 and 70 are provided with a transverse opening 88 receiving an eccentric 90 supported on a shaft 92 that is eccentrically arranged with respect to the eccentric 90 and is journaled in the bracket plates 48 or 66 with one end of the shaft 92 including a laterally extending member 94 having a bolt 96 in the end thereof which threadedly engages with one of a plurality of sockets 98 in the bracket plate 48 or 66 to enable the member 94 to be adjusted arcuately thus arcuately adjusting the shaft 92 and the eccentric 90 to move the mounting plate 50 or 70 radially inwardly and outwardly to adjust the saddle and bushing accurately and to compensate for wear when necessary until the bushing is replaced thus providing slide assemblies which can be adjusted to appropriately engage the rails 34 or 40 with the mounting structure for the bushings and saddle being the same in both of the slide assemblies 42 and 44. In order to replace the bushings 58 or 80, the bolt 96 is removed and member 94, shaft 92 and eccentric 90 are removed which permits mounting plates 50 or 70 to be removed. The bolts 64 or 86 can then be removed and the bushings 58 or 80 replaced. The slide assemblies 42 and 44 are then reassembled by reversing the above procedure.

The combination of the inner support rails 40 and the outer support rails 34 being induction hardened and chromed and the outer slide assembly 44 and the inner slide assembly 42 being adjustable and provided with accessible and replaceable bushings and saddles of arcuate configuration produces a telescopic boom that has a long life expectancy even in an environment of high abrasion and high cyclic operations without requiring lubrication with the structure also resisting rotation of the components about a longitudinal axis to facilitate utility of the boom support system. The structure of the slide assemblies provides simplified access for maintenance replacement when desired and the boom components may be provided with access openings or may be constructed of a frame-like girder structure which provides access to the interior of the boom for repair or replacement of any components that may be positioned within the boom.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A boom support system comprising telescopically arranged boom components in which an inner end of an outer boom component is telescopically received within an outer end of an inner boom component, each of said boom components including longitudinally extending structural frame means, a plurality of longitudinally continuous guide rails fixedly mounted in parallel relation and in circumferentially spaced relation on each of said boom components with the rails having a cylindrical cross-sectional configuration to form arcuate guide surfaces exposed inwardly and outwardly of the frame means, each of said boom components including slide assemblies mounted at the ends thereof with the slide assemblies including arcuate surfaces in sliding engagement with the frame rails to resist relative rotational displacement of the boom components about a longitudinal axis in relation to each other, said slide assemblies being located at the ends of the boom component which are telescopically related, the slide assemblies on the outer boom component facing outwardly and the slide assemblies on the inner boom component facing inwardly.

2. The boom support system as defined in claim 1 wherein each of said slide assemblies includes an arcuate saddle and an arcuate bushing mounted in the saddle with the bushing engaging the rail and means replaceably securing the bushing in the saddle to enable replacement thereof.

3. The boom support system as defined in claim 2 wherein each of said slide assemblies includes a mounting plate attached to the saddle and extending radially therefrom, a pair of axially extending bracket plates mounted on each boom components, an eccentric means mounting the mounting plate on the bracket plates to enable radial adjustment of each said saddle and each said bushing.

4. The boom support system as defined in claim 1 wherein each of said boom components has a polygonal transverse cross-sectional configuration with an apex at each corner thereof, said rails being mounted at the apices of the cross-sectional configuration of the boom components.

5. The boom support system as defined in claim 1 wherein each of said boom components has a square transverse cross-sectional configuration with an apex at each corner thereof, said rails being mounted at the apices of the cross-sectional configuration of the boom components.

6. The boom support assembly as defined in claim 1 wherein each of the frame means includes parallel side plates and parallel top and bottom plates, said guide rails being located at the junctures between the plates with the periphery of each rail projecting inwardly and outwardly of the plates.

7. The boom support system as defined in claim 1 wherein the telescoping ends of the boom components includes an end plate mounting the slide assemblies thereon.

* * * * *